US006852960B2

(12) United States Patent
Chun

(10) Patent No.: US 6,852,960 B2
(45) Date of Patent: Feb. 8, 2005

(54) MICROWAVE OVEN AND METHOD OF CONTROLLING THE SAME BY SETTING FUNCTION BUTTONS

(75) Inventor: Yun-Bong Chun, Seoul (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 38 days.

(21) Appl. No.: 10/376,296

(22) Filed: Mar. 3, 2003

(65) Prior Publication Data

US 2004/0069778 A1 Apr. 15, 2004

(30) Foreign Application Priority Data

Oct. 11, 2002 (KR) ..... 10-2002-0062031

(51) Int. Cl.[7] ..... H05B 6/68
(52) U.S. Cl. ..... 219/720; 219/702
(58) Field of Search ..... 219/702, 720

(56) References Cited

U.S. PATENT DOCUMENTS 4,309,584 A * 1/1982 Terakami ..... 219/720
4,351,999 A * 9/1982 Nagamoto et al. ..... 219/720
4,399,352 A * 8/1983 Ueda ..... 219/506
4,816,635 A * 3/1989 Edamura ..... 219/720
4,831,226 A * 5/1989 Robeson et al. ..... 219/702
5,504,311 A * 4/1996 DuBuis et al. ..... 219/720
6,444,965 B1 * 9/2002 Ha et al. ..... 219/702

* cited by examiner

*Primary Examiner*—Teresa J. Walberg
(74) *Attorney, Agent, or Firm*—Staas & Halsey LLP

(57) ABSTRACT

A microwave oven and a method of controlling the same determine if a plurality of buttons causing specific functions of the microwave oven to be executed have been pressed to set buttons for desired functions in a memory unit. If the desired functions have not been set, a control unit reads out the functions stored in the memory unit, causes the functions to be displayed on the display unit, allows a user to select the desired functions, and correspondingly sets the desired functions to the buttons. Meanwhile, if the desired functions have been set, the control unit deletes or executes the desired functions corresponding to the buttons on the basis of a continuous pressing time of the buttons. Accordingly, the microwave oven and the method may selectively set various functions of the microwave oven to a predetermined number of function buttons, allowing execution of desired functions rapidly and easily.

23 Claims, 3 Drawing Sheets

MICROWAVE OVEN AND METHOD OF CONTROLLING THE SAME BY SETTING FUNCTION BUTTONS

CROSS-REFERENCE TO RELATED APPLICATIONS

This application claims the benefit of Korean Application No. 2002-62031, filed Oct. 11, 2002, in the Korean Intellectual Property Office, the disclosure of which is incorporated herein by reference.

BACKGROUND OF THE INVENTION

1. Field of the Invention

The present invention relates, in general, to a microwave oven and method of controlling the same and, more particularly, to a microwave oven and method of controlling the same, which allows a user to set function buttons of the microwave oven according to a user's taste.

2. Description of the Related Art

In general, a microwave oven is a cooking apparatus that uses microwaves to cook food, a process different from using an external heating type cooking apparatus using heat conduction, heat radiation or the like.

The microwave oven is provided with a control panel on the front panel of a cabinet of the microwave oven. The control panel is provided with a plurality of buttons through which the operation of the microwave oven is controlled by a user, and a display window of a display unit which displays an operating state of the microwave oven, sets functions or the like.

Buttons on the control panel are used to select cooking methods desired by a user, and buttons used to carry out cooking using the selected cooking methods are selected by the user to start, select, cancel and do similar operations. Additionally, there are function buttons that are set to execute functions of the microwave oven, for example, a time setting function, a sound turning-on or off function and the like, that, for the user's convenience, are set by the user's one time manipulation.

However, as functions of the microwave oven have been further enhanced to satisfy the user's various demands and the development of technologies, the number of the function buttons has gradually increased. However, the space of the control panel on which the function buttons are mounted has become smaller, so the conventional microwave oven is problematic in that all the function buttons cannot be mounted on the space of the control panel.

Further, in the conventional microwave oven, functions of the microwave oven corresponding to the function buttons are fixed, and a user cannot change the fixed functions to other desired functions.

SUMMARY OF THE INVENTION

Accordingly, it is an aspect of the present invention to provide a microwave oven and method of controlling the same, which allows a user to set other functions arbitrarily to function buttons that have fixed functions of the microwave oven.

Another aspect of the present invention is to provide a microwave oven and method of controlling the same, in which the microwave oven is provided with special function buttons allowing functions of the microwave oven to be set by a user arbitrarily, thereby allowing the user to set functions of the microwave oven to the special function buttons as desired.

Additional aspects and advantages of the invention will be set forth in part in the description which follows and, in part, will be obvious from the description, or may be learned by practice of the invention.

The foregoing and/or other aspects of the present invention are achieved by providing a microwave oven including a memory unit previously storing a plurality of functions of the microwave oven, a plurality of buttons causing specific functions of the microwave oven to be executed when pressed, a display unit representing a screen allowing a user to select functions of the microwave oven which the user desires to set to the buttons, and a control unit correspondingly setting desired functions of the microwave oven to the buttons to cause the desired functions of the microwave oven selected through the represented screen to be executed when the buttons are pressed when the user sets the desired functions to the buttons.

The foregoing and/or other aspects of the present invention are achieved by providing a method of controlling a microwave oven, the microwave oven being provided with buttons through which specific functions of the microwave oven are set by a user, the method including determining whether functions of the microwave oven corresponding to the buttons have been set when the buttons are pressed, displaying a screen allowing the user to select functions of the microwave oven which the user desires to set the buttons when the functions of the microwave oven corresponding to the buttons have been set, determining whether the user selects the desired functions of the microwave oven through the displayed screen, correspondingly setting the desired functions of the microwave oven to the buttons when the user selects the desired functions of the microwave oven, and deleting or executing the desired functions of the microwave oven corresponding to the buttons by continuously pressing the buttons for a predetermined time when the functions of the microwave oven corresponding to the buttons have been set.

BRIEF DESCRIPTION OF THE DRAWINGS

These and/or other aspects and advantages of the invention will become apparent and more readily appreciated from the following description of the embodiments, taken in conjunction with the accompanying drawings of which.

DETAILED DESCRIPTION OF THE EMBODIMENTS

Figure 1:
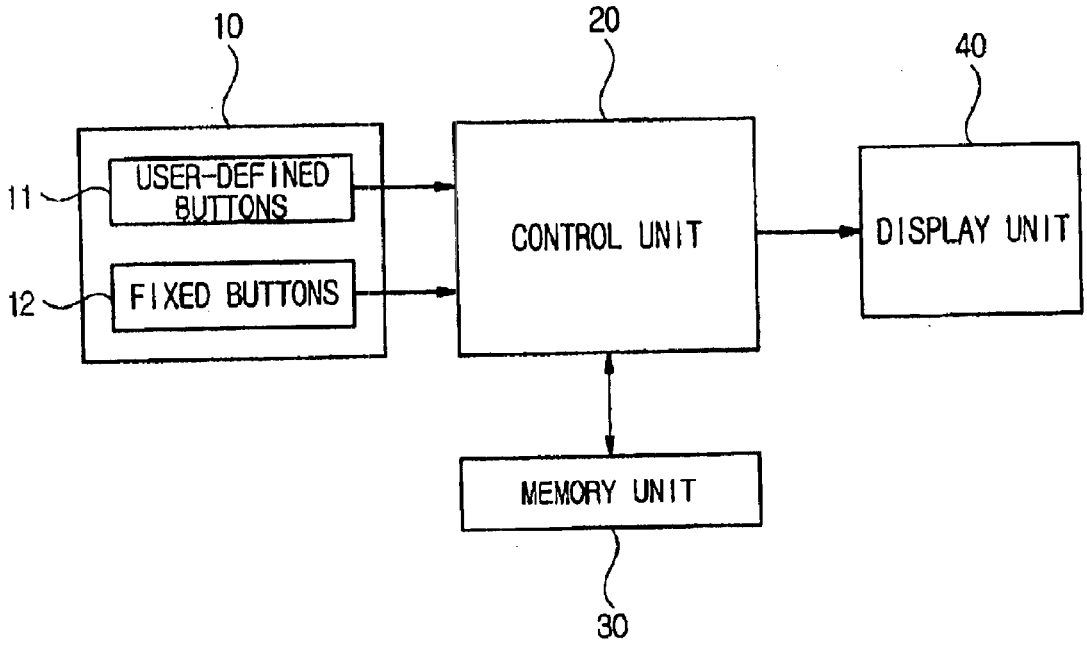
FIG. 1 is a control block diagram of a microwave oven in accordance with an embodiment of the present invention.

Reference will now be made in detail to the present embodiments of the present invention, examples of which are illustrated in the accompanying drawings, wherein like reference numerals refer to like elements throughout. The embodiments are described below in order to explain the present invention by referring to the figures.

Hereinafter, an embodiment of the present invention with reference to the accompanying drawings is described in detail. FIG. 1 is a control block diagram of a microwave oven in accordance with an embodiment of the present invention. As shown in FIG. 1, the microwave oven of the present invention includes a key input unit 10, which includes user-defined buttons 11, through which functions of the microwave oven are set according to a user's taste and fixed buttons 12 having fixed functions of the microwave oven associated therewith. The key input unit 10 outputs corresponding commands if a user presses the buttons 11 and 12.

Additionally, the microwave oven of the present invention includes a memory unit 30 that stores functions of the microwave oven that are executed when the user-defined buttons 11 and the fixed buttons 12 are pressed. In an embodiment, the memory unit 30 includes an Electrically Erasable Programmable Read-Only Memory (EEPROM). The memory unit 30 stores a plurality of functions of the microwave oven to permit the user to set desired functions to the user-defined buttons 11 arbitrarily and functions of the microwave oven corresponding to the fixed buttons 12. The functions of the microwave oven corresponding to the fixed buttons 12 may, for example, include an output power control function of the microwave oven, a cooking time setting function, a stand-by function and the like. The functions of the microwave oven set by the user to the user-defined buttons 11 may include a "CLOCK" function that sets general time, a "TIMER" function that sets cooking time, a "SOUND" function that turns on or off a sound, a "CUSTOM" function that performs a cooking course set by the user, a "REHEATING" function that automatically reheats food, a "DEFROST" function that automatically thaws food, a "DELAY_S" function that delays a start of cooking, a "+MIN" function that increases time by a certain number of minutes, a "−MIN" function that decreases time by a certain number of minutes, a "+/−" function that increases or decreases time in detail and the like.

Further, the microwave oven of the present invention includes a display unit 40 that displays a screen that allows a user to select one of the functions of the microwave oven stored in the memory unit 30, and a control unit 20 that performs the overall control operation of the microwave oven. The display unit 40 may, for example, include a display device, such as a Vacuum Fluorescent Display (VFD) device, a Light Emitting Diode (LED) device, a Liquid Crystal Display (LCD) device and the like.

Further, the control unit 20 reads out a function of the microwave oven which corresponds to a command outputted from the key input unit 10, from the functions of the microwave oven stored in the memory unit 30, and controls the read out function to be displayed on the display unit 40 to allow the user to manipulate the read out function of the microwave oven. Further, if a user-defined button 11 provided to the key input unit 10 is pressed, the control unit 20 causes functions of the microwave oven stored in the memory unit to be displayed on the display unit 40 to allow the user to set a desired function to the user-defined buttons 11. If one of the displayed functions of the microwave oven is selected, the selected function of the microwave oven is set to the user-defined button 11.

Figure 2:
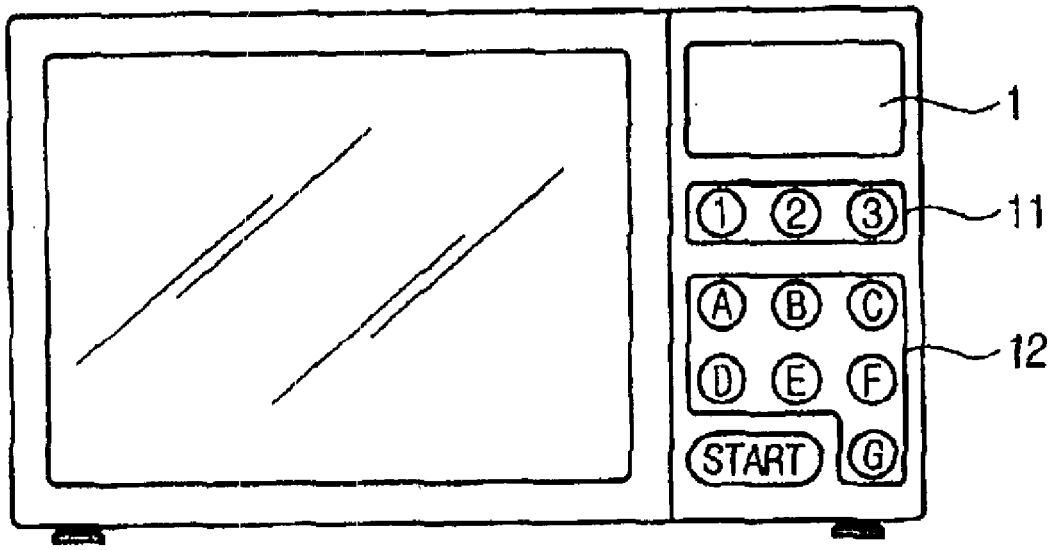
FIG. 2 is a front view of the microwave oven of FIG. 1, including a control panel.

Hereinafter, an example is described in which the user-defined buttons 11, the fixed buttons 12 and the display unit 40 shown in FIG. 1 are applied. FIG. 2 is a front view of the microwave oven of FIG. 1 including a control panel. As shown in FIG. 2, the control panel of the microwave oven is provided with a display window 1 of the display unit 40 that displays an operating state of the microwave oven, functions of the microwave oven previously stored, and buttons through which functions of the microwave oven are set or selected by a user. In FIG. 2, the buttons include three user-defined buttons 11 through which a user arbitrarily sets desired functions of the microwave oven, seven fixed buttons 12 to which functions of the microwave oven are previously fixed, and a start button which allows a user to start or progress cooking.

Figure 3:
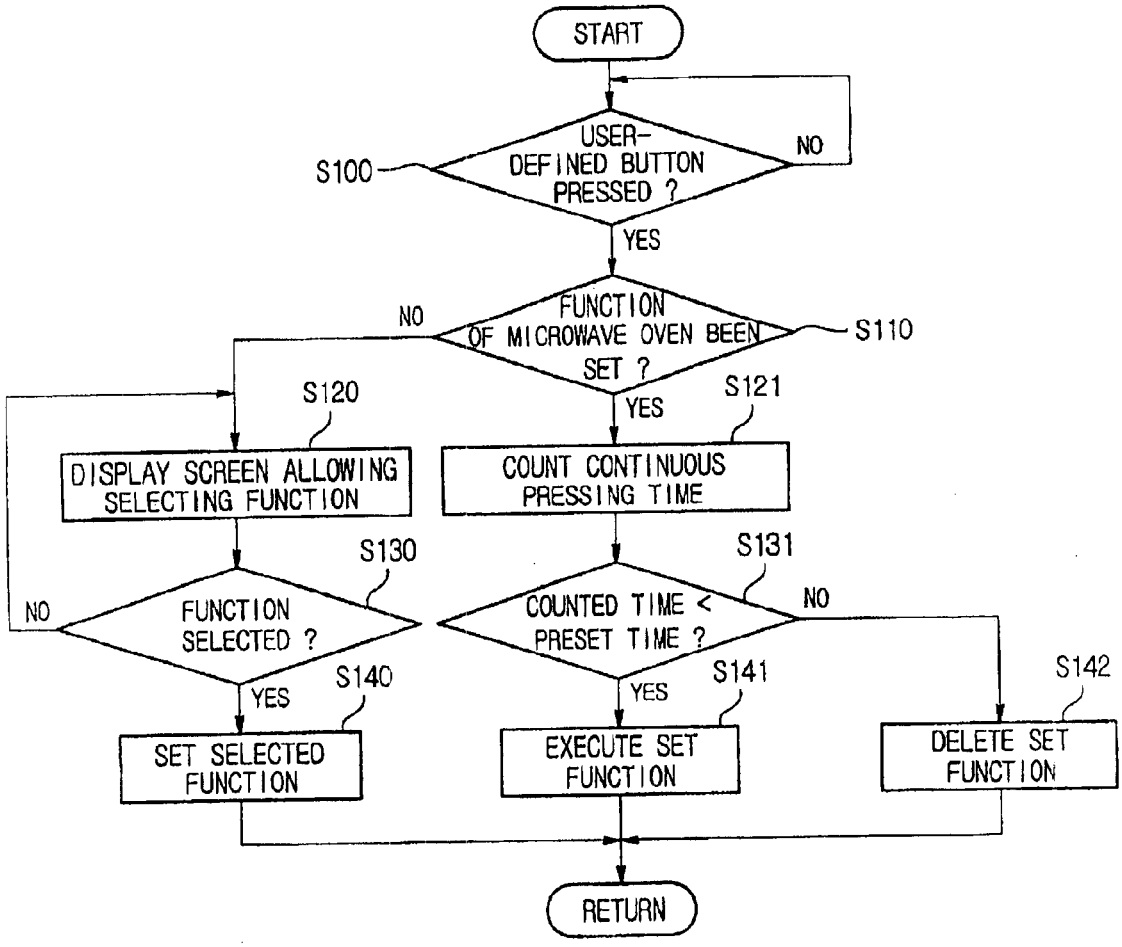
FIG. 3 is a control flowchart of a method of controlling the microwave oven of FIG. 1.

FIG. 3 is a control flowchart of a method of controlling the microwave oven of FIG. 1. As shown in FIGS. 2 and 3, the control unit 20 determines whether the user-defined button 11 provided to the key input unit 10 is pressed at operation S100. If the user-defined button 11 is pressed at operation S100, the control unit 20 scans the memory unit 30 and determines whether a function of the microwave oven corresponding to the user-defined button 11 has been set previously at operation S110.

If the function of the microwave oven corresponding to the user-defined button 11 has not been set previously at operation S110, the control unit 20 causes functions of the microwave oven stored in the memory unit 30 to be displayed on the display unit 40 to allow the user to select a function of the microwave oven which the user desires to set to the user-defined button 11 at operation S120. Accordingly, the user may select a desired function. For example, if the user continuously presses one of the user-defined buttons 11 when the display unit 40 includes a VFD, "CLOCK", "TIMER" and "SOUND", the functions of the microwave oven are scrolled on the display unit 40. If a certain time elapses after the "SOUND" function has been displayed, the start button flickers. Then, the user presses the start button and selects the "SOUND" function.

Thereafter, the control unit 20 determines whether the function of the microwave oven which the user desires to set to one of the user-defined buttons 11 is selected at operation S130. If the function of the microwave oven is selected at operation S130, the control unit 20 causes the selected function to be stored in the memory unit with the selected function corresponding to the user-defined buttons 11 at operation S140. Accordingly, the selected desired function of the microwave oven is set to the user-defined button 11. When the setting of the function to the single user-defined button 11 has been completed, the control unit 20 sets other user-defined buttons 11 to other desired functions in the same manner as described above.

On the other hand, if it is determined that the function of the microwave oven corresponding to one of the user-defined buttons 11 has been previously set at operation S110, the control unit 20 counts a time for which the user-defined button 11 is continuously pressed by the user at operation S121. Then, the control unit 20 compares the counted time with a preset time and determines whether the counted time is shorter than the preset time, for example, three seconds, at operation S131. If it is determined that the counted time is equal to or longer than the preset time at operation S131, the control unit 20 deletes the function of the microwave oven corresponding to the pressed user-defined button 11 from the memory unit 30 at operation S142.

Meanwhile, if it is determined that the counted time is shorter than the preset time at operation S131, the control unit 20 causes the desired function of the microwave oven set to a user-defined button 11 to be executed by the manipulation of the user in the same manner as manipulation of a conventional function button at operation S141. For example, a function of the microwave oven set to the user-defined button 11 may be executed as follows. The "SOUND" function set to the user-defined button 11 by the user is displayed in the case where the display unit 40 includes the VFD. Two seconds later, a "SET SOUND ON/OFF" message is scrolled on the display unit 40. If the user presses the user-defined button 11 once, a "SOUND ON" message is scrolled. If the user desires to set "SOUND OFF," the user presses the user-defined button 11 twice. If the user does not perform any manipulation for two seconds, a "PRESS START BUTTON" message is scrolled. If the user presses the start button, a "SOUND ON" is set.

A cooking unit (not shown) in the microwave oven supplies microwaves for use in cooking items disposed in the microwave oven.

According to one aspect of the present invention, the microwave oven includes a cooking unit to supply microwaves for use in cooking items disposed in the microwave oven, a memory unit previously storing a plurality of functions of the microwave oven, and a control system, coupled to the memory unit and the cooking unit, for enabling a user to set desired functions of the microwave oven. The control system generally includes a plurality of buttons causing specific functions of the microwave oven to be executed when pressed, a display unit having a screen that allows a user to select functions of the microwave oven which the user desires to set to the buttons, and a control unit to set desired functions of the microwave oven to the buttons in correspondence with functions selected on the display unit allowing the desired functions of the microwave oven selected through the screen to be executed when the buttons are pressed to set the buttons to the desired functions.

According to another aspect of the present invention, the microwave oven includes a cooking unit that supplies microwaves for cooking items disposed in the microwave oven and a management unit that enables a user to set desired functions of the microwave oven. The management unit typically includes a memory unit previously storing a plurality of functions of the microwave oven, a plurality of buttons causing specific functions of the microwave oven to be executed when pressed, a display unit having a screen that allows a user to select functions of the microwave oven which the user desires to set to the buttons, and a control unit that sets desired functions of the microwave oven to the buttons in correspondence with functions selected on the display unit allowing the desired functions of the microwave oven selected through the screen to be executed when the buttons are pressed to set the buttons to the desired functions.

As is apparent from the above description, the microwave oven and a method of controlling the same according to the present invention may selectively set various functions of the microwave oven to a predetermined number of function buttons of the microwave oven.

Further, the microwave oven and the method of controlling the same according to the present invention may execute desired functions of the microwave oven rapidly and easily while excluding undesired functions of the microwave oven.

Although a few embodiments of the present invention have been shown and described, it would be appreciated by those skilled in the art that changes may be made in these embodiments without departing from the principles and spirit of the invention, the scope of which is defined in the claims and their equivalents.

What is claimed is:

1. A microwave oven, comprising:

a memory unit previously storing a plurality of functions of the microwave oven;

a plurality of buttons, visible to the user, causing specific functions of the microwave oven to be executed when pressed;

a display unit having a screen allowing a user to select sound, cooking time and clock functions of the microwave oven which the user desires to set to the buttons; and a control unit setting desired functions of the microwave oven to the buttons in correspondence with functions selected on the display unit, allowing the desired functions of the microwave oven selected through the screen to be executed when the buttons are pressed.

2. The microwave oven as set forth in claim 1, wherein said control unit determines whether the desired functions of the microwave oven corresponding to the buttons have been set in the memory unit when the buttons are pressed;

if the desired functions of the microwave oven corresponding to the buttons have been determined to be set, said control unit reads out the functions of the microwave oven stored in the memory unit, causes the functions to be displayed on the display unit, allowing the user to select the desired functions of the microwave oven to be set to the buttons, and correspondingly sets the desired functions of the microwave oven selected by the user to the buttons; and if the desired functions of the microwave oven corresponding to the buttons have been determined to be set, said control unit deletes or executes the desired functions of the microwave oven corresponding to the buttons based on a time that the buttons are continuously pressed.

3. The microwave oven as set forth in claim 2, wherein said control unit deletes the desired functions of the microwave oven corresponding to the buttons if the time that the buttons are continuously pressed is equal to or longer than a preset time, and the control unit executes the desired functions of the microwave oven corresponding to the buttons if the time that the buttons are continuously pressed is shorter than the preset time.

4. The microwave oven as set forth in claim 1, wherein said memory unit includes an Electrically Erasable and Programmable Read-Only Memory (EEPROM).

5. The microwave oven as set forth in claim 1, wherein said display unit includes one of a Light Emitting Diode (LED) device, a Liquid Crystal Display (LCD) device and a Vacuum Fluorescent Display (VFD) device.

6. The microwave oven as set forth in claim 1, wherein selection of functions of the microwave oven is performed by the buttons.

7. A method of controlling a microwave oven, the microwave oven being providing with buttons, visible to the user, through which sound, cooking time and clock functions of the microwave oven are set by a user, comprising:

determining whether functions of the microwave oven corresponding to the buttons have been set when the buttons are pressed;

displaying a screen allowing the user to select sound, cooking time, and clock functions of the microwave oven which the user desires to set to the buttons when the functions of the microwave oven corresponding to the buttons have not been set;

determining whether the user selects desired functions of the microwave oven through the screen;

correspondingly setting the desired functions of the microwave oven to the buttons when the user selects the desired functions of the microwave oven; and deleting or executing the desired functions of the microwave oven corresponding to the buttons on the basis of continuous pressing time of the buttons if the functions of the microwave oven corresponding to the buttons have been set.

8. The method as set forth in claim 7, wherein said deleting or executing the desired functions comprises:

counting the continuous pressing time of the buttons;

determining whether the continuous pressing time of the buttons is equal to or longer than a preset time;

deleting the desired functions of the microwave oven corresponding to the buttons if the continuous pressing time of the buttons is equal to or longer than the preset time; and executing the desired functions of the microwave oven corresponding to the buttons if the continuous pressing time of the buttons is shorter than the preset time.

9. The method as set forth in claim 8, wherein deleting or executing the desired functions includes using an Electrically Erasable and Programmable Read-Only Memory (EEPROM) to delete or execute the desired functions.

10. The method as set forth in claim 7, wherein displaying a screen includes using one of a Light Emitting Diode (LED) device, a Liquid Crystal Display (LCD) device and a Vacuum Fluorescent Display (VFD) device to display the screen allowing the user to select the functions of the microwave oven.

11. A microwave oven, comprising:

a cooking unit to supply microwaves for use in cooking items disposed in the microwave oven;

a memory unit previously storing a plurality of functions of the microwave oven; and a control system, coupled to the memory unit and the cooking unit, for enabling a user to set sound, cooking time and clock functions of the microwave oven, the control system comprising:

a plurality of buttons, visible to the user, causing specific functions of the microwave oven to be executed when pressed, a display unit having a screen that allows the user to select sound, cooking time, and clock functions of the microwave oven which the user desires to set to the buttons, and a control unit setting desired functions of the microwave oven to the buttons in correspondence with functions selected on the display unit, allowing the desired functions of the microwave oven selected through the screen to be executed when the buttons are pressed to set the buttons to the desired functions.

12. The microwave oven as set forth in claim 11, wherein said control unit determines whether the desired functions of the microwave oven corresponding to the buttons have been set in the memory unit when the buttons are pressed;

if the desired functions of the microwave oven corresponding to the buttons have been set, said control unit reads out the functions of the microwave oven stored in the memory unit, causes the functions to be displayed on the display unit, allowing the user to select the desired functions of the microwave oven to set to the buttons, and correspondingly sets the desired functions of the microwave oven selected by the user to the buttons; and if the desired functions of the microwave oven corresponding to the buttons have been set, said control unit deletes or executes the desired functions of the microwave oven corresponding to the buttons based on a time that the buttons are continuously pressed.

13. The microwave oven as set forth in claim 12, wherein said control unit deletes the desired functions of the microwave oven corresponding to the buttons if the time that the buttons are continuously pressed is equal to or longer than a preset time, and the control unit executes the desired functions of the microwave oven corresponding to the buttons if the time that the buttons are continuously pressed is shorter than the preset time.

14. The microwave oven as set forth in claim 11, wherein said memory unit includes an Electrically Erasable and Programmable Read-Only Memory (EEPROM).

15. The microwave oven as set forth in claim 11, wherein said display unit includes one of a Light Emitting Diode (LED) device, a Liquid Crystal Display (LCD) device and a Vacuum Fluorescent Display (VFD) device.

16. The microwave oven as set forth in claim 11, wherein the selection of functions of the microwave oven is performed by the buttons.

17. A microwave oven, comprising:

a cooking unit to supply microwaves for use in cooking items disposed in the microwave oven; and a flexible management unit, coupled to the cooking unit, to enable a user to set sound, cooking time and clock functions of the microwave oven to buttons, visible to the user, previously utilized for other functions.

18. The microwave oven of claim 17, wherein the flexible management unit comprises:

a memory unit previously storing a plurality of functions of the microwave oven;

a plurality of buttons causing specific functions of the microwave oven to be executed when pressed;

a display unit having a screen that allows the user to select functions of the microwave oven which the user desires to set to the buttons; and a control unit setting desired functions of the microwave oven to the buttons in correspondence with functions selected on the display unit allowing the desired functions of the microwave oven selected through the screen to be executed when the buttons are pressed to set the buttons to the desired functions.

19. The microwave oven as set forth in claim 18, wherein said control unit determines whether the desired functions of the microwave oven corresponding to the buttons have been set in the memory unit when the buttons are pressed;

if the desired functions of the microwave oven corresponding to the buttons have been set, said control unit reads out the functions of the microwave oven stored in the memory unit, causes the functions to be displayed on the display unit, allowing the user to select the desired functions of the microwave oven to set to the buttons, and correspondingly sets the desired functions of the microwave oven selected by the user to the buttons; and if the desired functions of the microwave oven corresponding to the buttons have been set, said control unit deletes or executes the desired functions of the microwave oven corresponding to the buttons based on a time that the buttons are continuously pressed.

20. The microwave oven as set forth in claim 19, wherein said control unit deletes the desired functions of the microwave oven corresponding to the buttons if the time that the buttons are continuously pressed is equal to or longer than a preset time, and the control unit executes the desired functions of the microwave oven corresponding to the buttons if the time that the buttons are continuously pressed is shorter than the preset time.

21. The microwave oven as set forth in claim 18, wherein said memory unit includes an Electrically Erasable and Programmable Read-Only Memory (EEPROM).

22. The microwave oven as set forth in claim 18, wherein said display unit includes one of a Light Emitting Diode (LED) device, a Liquid Crystal Display (LCD) device and a Vacuum Fluorescent Display (VFD) device.

23. The microwave oven as set forth in claim 18, wherein the selection of functions of the microwave oven is performed by the buttons.

* * * * *

UNITED STATES PATENT AND TRADEMARK OFFICE

CERTIFICATE OF CORRECTION

PATENT NO. : 6,852,960 B2
DATED : February 8, 2005
INVENTOR(S) : Yun-Bong Chun

It is certified that error appears in the above-identified patent and that said Letters Patent is hereby corrected as shown below:

Column 6,
Line 42, change "providing" to -- provided --.

Signed and Sealed this

Thirteenth Day of December, 2005

JON W. DUDAS
*Director of the United States Patent and Trademark Office*